United States Patent [19]

Schiel

[11] 4,267,644

[45] May 19, 1981

[54] ROTATABLE HOLLOW CYLINDER, PARTICULARLY USEFUL AS THE DRYING CYLINDER FOR A PAPER MACHINE

[75] Inventor: Christian Schiel, Heidenheim, Fed. Rep. of Germany

[73] Assignee: J. M. Voith GmbH, Fed. Rep. of Germany

[21] Appl. No.: 107,545

[22] Filed: Dec. 27, 1979

[30] Foreign Application Priority Data

Feb. 1, 1979 [DE] Fed. Rep. of Germany ..... 2903784

[51] Int. Cl.[3] ..... F26B 25/20

[52] U.S. Cl. ..... 34/110; 34/119; 34/124; 34/231; 165/89; 165/109 R

[58] Field of Search ..... 34/110, 119, 124, 125, 34/108; 165/76, 89, 109; 366/228; 432/118

[56] References Cited

U.S. PATENT DOCUMENTS 2,097,124 10/1937 Kelsey ..... 366/228
2,816,742 12/1957 Richterkessing et al. ..... 366/228
3,808,700 5/1974 Kraus ..... 34/124
4,195,417 4/1980 Mathews ..... 34/110

*Primary Examiner*—Larry I. Schwartz
*Attorney, Agent, or Firm*—Ostrolenk, Faber, Gerb & Soffen

[57] ABSTRACT

The disclosure concerns a hollow rotatable cylinder which is particularly useful as the drying cylinder for a paper machine. A circumferentially spaced apart array of sets, each comprised of at least a pair of axially arrayed cleats, are positioned around the inner cylindrical wall of the cylinder. Each cleat is comprised of a strip of sheet metal folded over a bar in direct engagement with the cylinder wall. Axial end pins on the cleats extend radially outwardly into boreholes provided in the inner cylinder wall. The end pins are dimensioned so that adjacent end pins of axially adjacent cleats may be received in a common borehole. In addition, a resilient holding ring may outwardly bias the cleats toward the inner cylinder wall. Finally, the cleats may be magnetically attracted to the inner cylinder wall for being held there.

12 Claims, 3 Drawing Figures

ROTATABLE HOLLOW CYLINDER, PARTICULARLY USEFUL AS THE DRYING CYLINDER FOR A PAPER MACHINE

BACKGROUND OF THE INVENTION

The present invention relates to a rotatable hollow cylinder, particularly useful as a drying cylinder for a paper machine.

Typically, such a cylinder is heated with a condensable fluid. On the cylindrical inner surface of the cylinder, there is an array of at least two moldings or cleats extending in the axial direction of the cylinder, which are fixed in boreholes provided in the inner surface of the wall of the cylinder. Such cleats or moldings are provided in drying cylinders because they increase the turbulance of the condensate that collects in a cylindrical layer about the inner surface of the cylinder at high peripheral speeds. Thus the heat transfer into the cylinder wall is improved.

In German Provisional Patent (Auslegeschrift) No. 23 03 334 and corresponding U.S. Pat. No. 3,808,700, cleats or moldings are fastened at the centers by screws located in threaded holes in the cylinder wall and the ends of which engage in each other. If a screw should happen to loosen, the entire cleat assembly becomes loose and the cleats might turn around their fastening screw. Furthermore, the deep threaded holes impair the mechanical strength of the cylinder wall. Additionally, producing threaded holes in the wall of the cylinder is a time-consuming operation.

To avoid the foregoing disadvantages, German Provisional Patent Auslegeschrift No. 23 30 199 suggests fastening the cleats or moldings merely by connecting them to each other by means of spring bars. This takes up a large amount of space within the cylinder and also results in difficulties in maintaining the cleats or moldings at the same distance apart on the inner surface of the cylinder.

SUMMARY OF THE INVENTION

The primary object of the present invention is to assure permanent attachment of the moldings or cleats to the inner surface of the cylinder.

Another object is to obtain such attachment without impairing the cylinder wall to the same extent as occurs with the known threaded holes.

According to the invention, each cleat or molding is provided at its axial ends with end pins which extend toward the cylinder wall. Adjacent end pins of two axially consecutive cleats or moldings extend into a common borehole formed in the cylinder wall. It is thereby possible to reduce by one-half the number of end pin receiving boreholes, as compared with axially consecutive cleats that are fastened with two screws. Furthermore, it is not necessary to cut threads into the boreholes. This results in an enormous saving of time in the manufacture and assembly of the cylinder and less weakening of the wall of the cylinder.

The end pins of the cleats or moldings may be thinner in the longitudinal direction of the cleats or moldings than in the direction transverse thereto, i.e. the circumferential direction of the cylinder. In this way, the diameter of the boreholes that receive two cleat pins can be reduced.

Furthermore, in accordance with the invention, the two end pins of a cleat or molding can be adapted, through plastic deformation of the material of which the cleat is comprised, to the axial distance between the respective boreholes for that cleat in the wall of the cylinder. Thus, the cleats or moldings can be adjusted to the exact spacing of the boreholes in simple manner by plastic deformation. This can be done particularly easily if the pins are developed as bent-off extensions of the cleats and if the cleats or moldings are formed of sheet-metal.

To prevent the cleats or moldings coming loose from the cylinder wall in a radial direction, it is proposed that the pins be pressed into the boreholes and be held there by pressure. Simultaneously, or as an alternative, a ring, preferably resilient and with spring-action, can be provided inside the cylinder. It presses the cleats or moldings radially outwardly against the wall of the cylinder. The fastening of the holding ring is effected in simple and reliable manner, preferably by a detachable snap fastening between the holding ring and the cleats or moldings.

In another embodiment, the cleats or moldings in accordance with the invention may also be magnetic or have magnets in them, so that the cleats are held fast magnetically to the cylinder wall, which normally is comprised of a ferromagnetic material so that the magnetic cleats will be secured.

Other objects and features of the invention will be understood from the several embodiments thereof described below with reference to the accompanying drawings.

DESCRIPTION OF THE PREFERRED EMBODIMENTS

Figure 1:
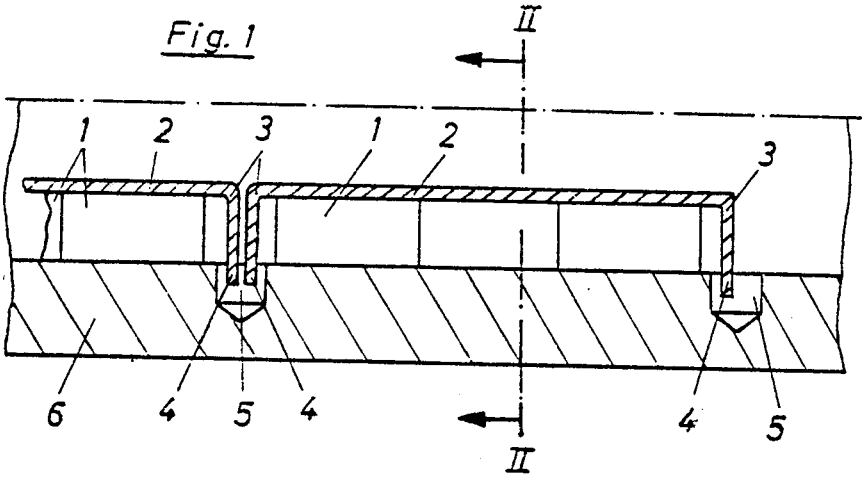
FIG. 1 is a partial longitudinal sectional view through a cylinder in accordance with the invention.
Figure 2:
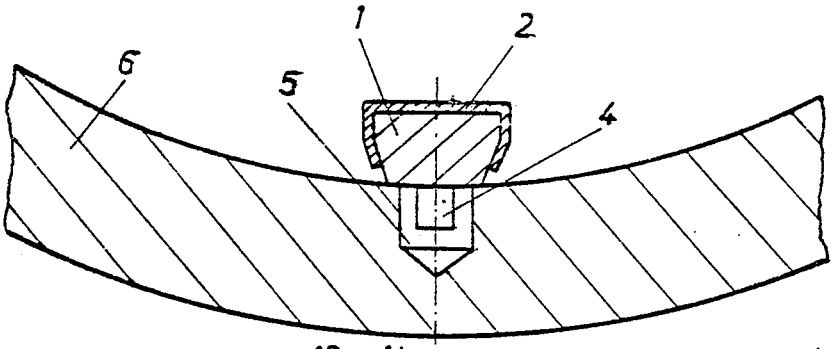
FIG. 2 is a cross-section in the region of a borehole in the cylinder wall along the line II—II.

Referring to FIGS. 1 and 2, a hollow drying cylinder 6 for a paper making machine is shown. A plurality of bar elements 1 are mounted at circumferentially, preferably uniformly, spaced apart locations around the interior surface of the cylinder 6. The bars are arranged in a set, comprised of at least two bars. Each bar extends axially of the cylinder and the bars in a set are arrayed in an axially extending row. Each bar 1 is shaped with a tapered undercut section nearer to the inner cylinder wall, for being clenched by a respective cleat or molding 2.

Each bar 1 is wrapped in a profiled molding or cleat 2 comprised of sheet metal. Together, the cleat and its respective bar define cleat means. The cleats 2 are shaped and bent so that their longitudinal sides wrap around the respective bars 1 down to the undercuts and so that the axial ends 3 of the cleats define the pins 4. These pins extend radially outwardly into blind unthreaded boreholes 5 formed in the cylinder wall 6.

FIG. 2 shows one possible way in which the bar elements 1 can be arranged in the cleat or molding 2. By comparing FIGS. 1 and 2, it can be noted that the pins 4 may be wider in the circumferential direction than they are long in the longitudinal direction of the cylinder, e.g. they may be twice as large in the circumferential direction as in the longitudinal direction. This enables two axially adjacent pins 4 together to have the same size as one pin has in the circumferential direction. This is advantageous because the boreholes 5 then need only have a relatively small diameter. Furthermore, the shapes of the pins and their composition of sheet metal and the cleats being comprised of sheet metal enable the pins to be plastically deformed or bent to fit into and be at the correct location to extend into their respective boreholes. The dimensions of the pins 4 and boreholes 5 are selected so that the pins will be securely held in, and even press fit into, the boreholes 5.

As an alternative to the above described precise dimensioning of the pins 4, or in addition thereto, the cleats or moldings 2 and usually also then the bars 1 are comprised of magnetized material, while the cylinder 6 is comprised of steel, whereby the cleats or moldings 2 will be magnetically securely held to the cylinder wall.

Figure 3:
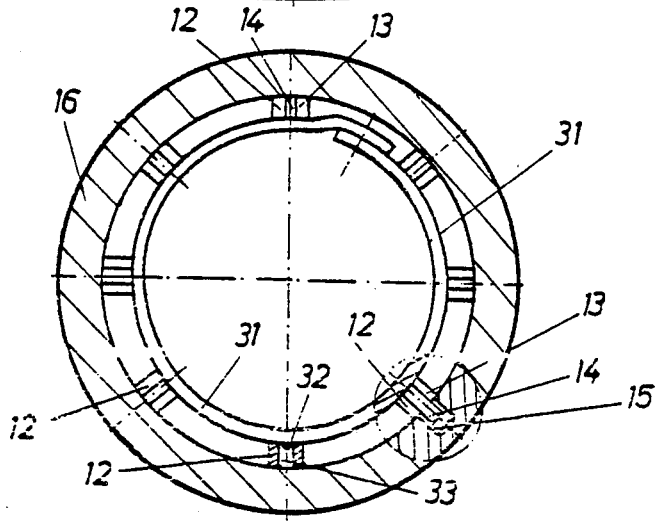
FIG. 3 is a cross-sectional view through another embodiment of a cylinder in accordance with the invention.

FIG. 3 shows a cross-section through a cylinder wall 16 with cleats 12 or moldings resting against its inner surface. The axial ends 13 of the cleats are provided with folded down (and radially outwardly extending) pins 14, which extend into boreholes 15 formed in the interior surface of the cylinder wall 16. The circled portion in FIG. 3 is a sectional view at the place where a pin 14 extends into a borehole 15.

A resilient, split, normally outwardly biased, metal ring 31 presses the cleats 12 against the cylinder wall 15. In order to secure the ring 31 against circumferential motion, it is provided with external projections 32 which extend into radial openings 33 provided in the cleats 12 to provide a detachable snap fastening.

Although the present invention has been described in connection with a preferred embodiment thereof, many variations and modifications will now become apparent to those skilled in the art. It is preferred, therefore, that the present invention be limited not by the specific disclosure herein, but only by the appended claims.

I claim:

1. A hollow rotatable cylinder having a cylindrical inner wall;

a set comprising at least two cleat means, each being profiled to project radially inwardly into said cylinder, each extending in the axial direction of said cylinder, each being located at said cylindrical inner wall, and said cleat means of said set being arranged in an axially extending row; said cleat means each being comprised of a cleat; each said cleat having opposite axial ends; said cleats in said set of cleat means being arrayed axially adjacent; each said cleat end having a respective end pin thereon that extends toward said cylindrical inner wall;

boreholes being provided in said cylindrical inner wall generally at the locations toward which said end pins extend;

said boreholes being so shaped and said end pins of said axially adjacent cleats being so positioned that said adjacent end pins of two axially adjacent cleats extend into a common one of said boreholes.

2. The cylinder of claim 1, wherein each said pin is thinner in the axial direction of said cleat than in the circumferential direction of said cylinder.

3. The cylinder of either of claims 1 or 2, wherein said end pins are plastically deformable each so as to be able to extend into the respective said borehole therefor.

4. The cylinder of claim 3, wherein said pins and said boreholes are respectively so shaped, and said end pins are so deformed, that said pins are press fitted into the respective said boreholes.

5. The cylinder of either of claims 1 or 2, wherein said end pins are plastically deformable and said boreholes are respectively so shaped that said pins are press fitted into the respective said boreholes therefor.

6. The cylinder of either of claims 1 or 2, further comprising additional securing means for securing said cleat means to said cylindrical inner wall by applying a force upon said cleat means in the radially outward direction of said cylinder.

7. The cylinder of claim 6, wherein said additional securing means comprises a holding ring for applying radially outwardly directed force on said cleat means.

8. The cylinder of claim 7, wherein said holding ring is yieldable under spring action in the radial direction.

9. The cylinder of claim 8, wherein said holding ring and said cleats are connected with each other by respective detachable snap fastenings therebetween.

10. The cylinder of claim 1, wherein said cleat means are magnetic for magnetically adhereing to said cylindrical inner wall.

11. The cylinder of either of claims 1 or 2, further comprising a plurality of circumferentially spaced apart said sets, each comprised of at least two said cleat means.

12. The cylinder of claim 7, wherein said holding ring and said cleats are connected with each other by respective detachable snap fastenings therebetween.

* * * * *